US005420624A

United States Patent [19]

Braun et al.

[11] Patent Number: 5,420,624

[45] Date of Patent: May 30, 1995

[54] METHOD AND APPARATUS FOR CORRECTING PRINTING DISTORTIONS IN AN INK JET PRINTER

[75] Inventors: Timothy Braun, Roselle, Ill.; Bruce Ortquist, Upper Arlington, Ohio; Robert I. Keur, Niles, Ill.

[73] Assignee: Videojet Systems International, Inc., Niles, Ill.

[21] Appl. No.: 840,161

[22] Filed: Feb. 24, 1992

[51] Int. Cl.[6] ..... B41J 2/085

[52] U.S. Cl. ..... 347/76; 347/79

[58] Field of Search ..... 347/76, 78, 79, 80–81, 347/55, 74, 82, 90

[56] References Cited

U.S. PATENT DOCUMENTS

| | | | |
|---|---|---|---|
| 4,395,717 | 7/1983 | Horike et al. | 347/76 |
| 4,400,705 | 8/1983 | Horike | 347/14 |
| 4,432,003 | 2/1984 | Barbero et al. | 347/55 |
| 4,519,696 | 5/1985 | Bruyndoncky et al. | 355/208 |
| 4,673,951 | 6/1987 | Mutoh et al. | 347/15 |
| 4,994,821 | 2/1991 | Fagerquist | 347/81 |

OTHER PUBLICATIONS

G. F. Fillmore et al. Drop Charging and Deflection in an Electrostatic Ink Jet Printer, Jan. 1977 pp. 37–47.

R. G. Sweet, High-Frequency Oscillography with Electrostatically Deflected Ink Jets; Mar. 1964.

Elaine Pullen paper on Ink Jet Printing, Mar., 1982.

*Primary Examiner*—A. T. Grimley

*Assistant Examiner*—Thu Dang

*Attorney, Agent, or Firm*—Rockey, Rifkin and Ryther

[57] ABSTRACT

Printing distortions caused by ink stream/charge tunnel misalignment, charge tunnel mis-dimensioning or a variation in drop spacing or changes in ink resistivity are corrected by measuring the actual induction co-efficients for a particular printer. For this purpose, charge sensors located along the ink stream or adjacent the ink catcher detect induced charges from which the induction co-efficients are calculated by a programmable controller. These co-efficients are used to adjust the charge tunnel voltages to reduce or eliminate printing distortion.

17 Claims, 10 Drawing Sheets

Figure 3

EE4 77 99 --
N = = P P 03 034

Figure 4

EE4 77 99 --
N = = P P 03 034

Figure 5

EE4 77 99 --
N = = P P 03 034

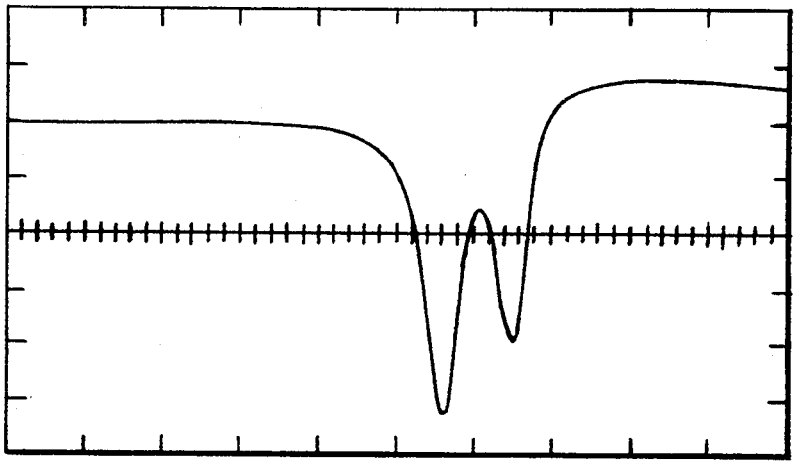
FIG. 6
FIG 9
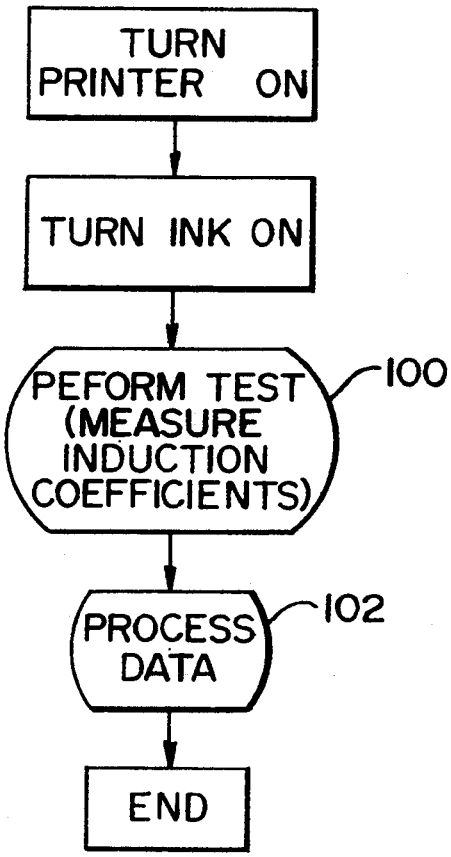

METHOD AND APPARATUS FOR CORRECTING PRINTING DISTORTIONS IN AN INK JET PRINTER

BACKGROUND OF THE INVENTION

This invention relates to ink jet printers. More particularly it relates to ink jet printers of the type which form drops from a stream or streams of ink, charge the drops and then deflect them onto a substrate to be marked. Such devices are well known in this art.

Printing distortions have long been a problem with ink Jet printers. Many of the causes are well known and include variation in ink quality, improper jet nozzle drive and improper proximity to the substrate. Recent research has indicated another important cause of distortion exists, which emanates from non-proportional changes in charging.

Ink jet printing devices typically employ a programmable controller (PC) to set the various parameters necessary for proper operation. The PC includes memory containing drop position compensation data for each graphic or alpha-numeric character to be printed. This data is created at the factory when the jet stream is carefully centered within the charging electrode. This data is used on all ink jet machines of the same model. Actual printers, for one reason or another, tend to have their ink streams misaligned within the electrode or have their drop spacing or electrode width somewhat out of specification. Indeed, mechanical stream alignment is difficult to accurately achieve in the field. If the stream is not well aligned distortions in ink jet printing will occur such as illustrated in FIG. 4. This problem is particularly evident when every drop printing is employed, and to a lesser extent with every other drop printing. The present invention teaches various ways by which these distortions can be corrected. In addition, the invention can compensate for changes in electrical resistivity in the ink. This invention is particularly important for use in multi-jet printers to maintain consistent quality throughout an array of jets.

It is accordingly an object of the invention to provide a method and apparatus for correcting printing distortions which occur in ink jet printers due to non-proportional changes in charging of the drops.

Another object of the invention is to provide improved ink jet printing of characters on a substrate by adjusting the charge voltages to accommodate machine to machine variations.

A further object of the invention is to provide an automatic compensation method for field calibrating ink jet printers to maintain high print quality. These and other objects of the invention will be apparent from the remaining portion of the specification.

BRIEF DESCRIPTION OF THE DRAWINGS

FIGS. 3, 4 and 5 are reproductions of alpha-numeric characters produced by a properly aligned charge tunnel (FIG. 3), a misaligned charge tunnel (FIG. 4); and a misaligned charge tunnel adjusted according to the invention (FIG. 5).

FIG. 6 is a waveform showing the effect of capacitive coupling between two adjacent charged ink drops.

FIGS. 9–14 are flow diagrams useful in explaining the implementation of the invention for a programmable controller.

DETAILED DESCRIPTION

Figure 1:
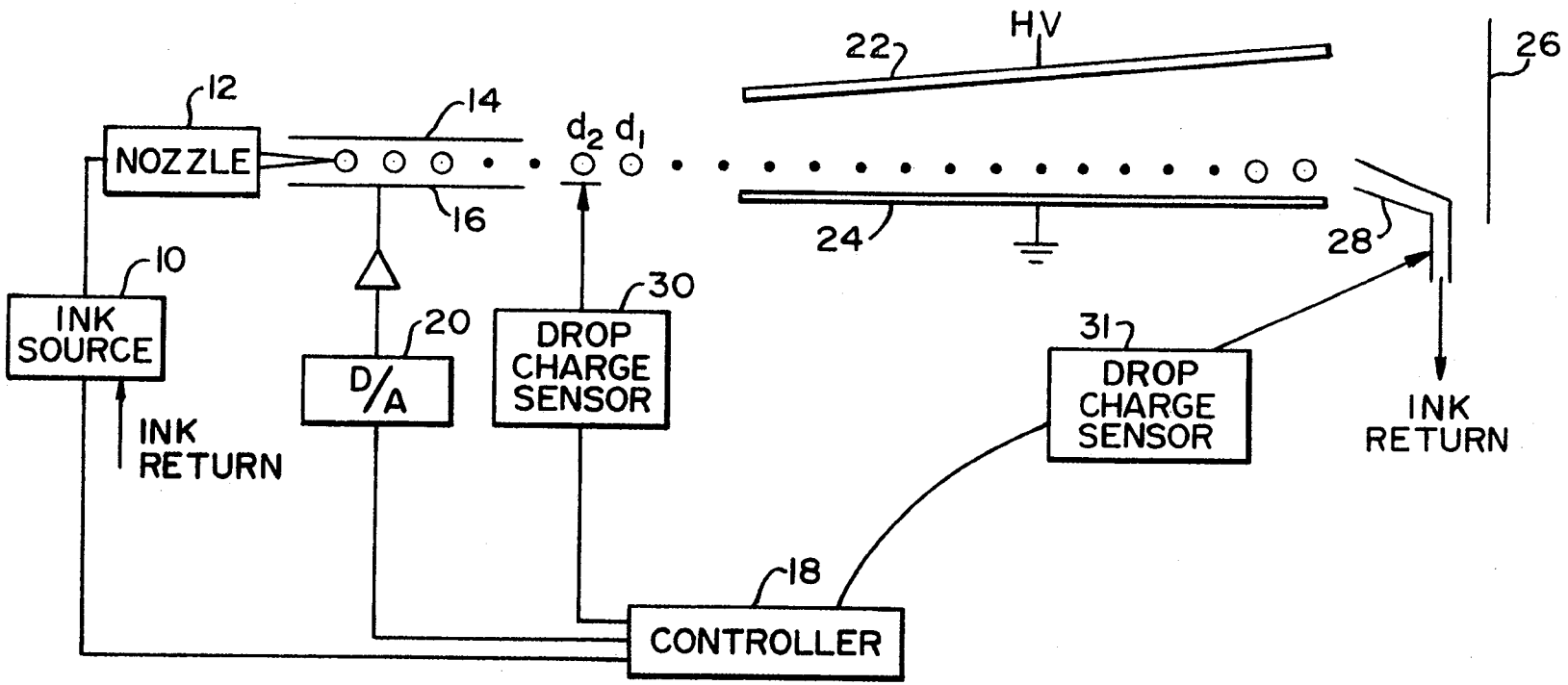
FIG. 1 is a schematic diagram of a typical ink jet printer system suitable for use with the present invention.

Referring to FIG. 1, a typical ink jet printer arrangement is illustrated. Ink is supplied under pressure from a source 10 to a nozzle 12. Stimulation energy is applied to the nozzle, usually by means of a piezo-electric device to cause the ink stream issuing from the nozzle to break up into a series of drops. The drops pass through a charge tunnel consisting of a pair of plates 14 and 16 or a horseshoe or annular shaped tunnel, as may be desired. The tunnel applies a charge to selected drops responsive to signals from a programmable controller 18 via a digital to analog converter 20. The drop stream next passes through a pair of high voltage deflection plates 22 and 24 which deflect the charged drops onto a substrate 26 to be marked. Uncharged drops pass into a catcher 28 and are returned to the ink source 10 for further use.

For purposes of explaining and practicing the present invention, it is desirable to detect the charge on the drops after they leave the charge tunnel. For that purpose, a drop charge detector 30 or 31, depending upon which of the methods described hereafter is employed, is provided. The outputs of the detectors are supplied to the programmable controller 18.

The charge on a drop breaking off in the tunnel 14 is a function of: (1) the capacitive and resistive coupling of the unbroken ink stream to the charge tunnel; (2) the capacitive coupling of the break-off drop to the charged drops preceding it. Consequently, the charge on the stream due to capacitive and resistive coupling and on the break-off drop is proportional to the potential on the charge tunnel minus a fraction of the charge on the drop preceding it by one drop time (approximately in the range of 7% to 20%), a smaller fraction of the charge on the drop preceding it by two drop times (approximately in the range of 1% to 4%), and so on. These fractions are sometimes referred to as "induction fractions". This drop charge induction phenomenon is accounted for by initial drop position compensation. If field conditions are different from initial compensation conditions such that the induction effects change, an adjustment to the compensation data is necessary. For, example, the charging voltage values stored in the programmable controller's memory may be increased for drops following charged drops to negate the effect of the induction loss.

Print quality for fonts utilizing every drop is significantly degraded if the charge tunnel is not centered about the stream, if the charge tunnel width is incorrect or if the drop spacing is incorrect. This is because the induction fractions differ from the drop charge compensation values stored in the PC memory. As a result, certain drops are charged incorrectly (i.e. drops following charged drops usually receive incorrect charge) causing print quality difficulties. FIGS. 3 and 4 illustrate the problem. FIG. 3 shows print results with proper alignment while FIG. 4 illustrates the degradation in quality due to misalignment.

At the present time, to ensure good print quality when printing with every drop, it is necessary to demand very accurate drop spacing charge tunnel spacing and orientation about the stream. The second and third of these requirements are difficult to achieve in practice due to tolerance errors in the nozzle/charge tunnel system. As a result, it has been necessary to design an adjustable charge tunnel which can be field adjusted relative to the stream.

The present invention provides an automatic system which adjusts the charging voltages for changes in the induction fractions for each particular machine. The advantage is that it avoids the need for strict mechanical tolerances on the nozzle/charge tunnel system and/or adjustment of the charge tunnel. The necessary corrections can be obtained during a print quality calibration procedure when the printer is turned on.

There are various ways that the inductive fractions can be determined. For example, a charged drop can be separated from induced charge drops by a deflection scheme. The induced charge drops carry a much lower, opposite charge and therefore are easy to separate. A ratio of the stream charge measured without deflecting the drop to that measured when the drop is deflected gives the sum of the induction fractions.

Preferably, however, during start-up (and before the deflection voltage to plates 22 and 24 is turned on), various voltage charge patterns can be applied to the drops. These patterns can be detected by a downstream drop charge sensor to measure the value of the inductive fractions. A small capacitive pickup associated with detector 30 can distinguish individual drop charge amplitudes as they pass by. In FIG. 6 two drops charged with identical charging voltages show a difference in the pickup output amplitude. The second drop will have a lower amplitude due to the first order inductive fraction effect. The voltages can then be adjusted until the pickup amplitudes are equal. The difference in charging voltages can be used to determine the 1st order inductive fraction. In the present instance, the charging electrode is the positive plate of a capacitor and the ink stream is the negative plate. This "negative plate" is connected to ground through the conductive ink. The positive or higher potential is placed on the charging electrode.

Thus:

ti $q_0 = -CV(1-e^{-T/RC})$ where T is the drop period and RC is the drop charging time constant. For a specific T and R the equation may be written as:

$$q_0 = -CV_0 f$$

where $f = 1 - e^{-T/RC}$.

Similarly, $$q_1 = -fC(V_1 - V_0 I_1)$$

where $I_1$ is hereafter defined as $I_1 + f - 1$; and C is the capacitance for drop charging, $V_0$ and $V_1$ are the voltages applied to the charging electrode charging drops 0 and 1 to charges $q_0$ and $q_1$ respectively. $I_1$ is the first order inductive fraction affecting $q_1$.

Requiring that $q_0 = q_1$ for equal charge amplitude detection at the sensor yields:

$$V_0 = V_1 - V_0 * I_1$$

$$I_1 = V_1/V_0 - 1$$

As an example if $V_0$ were 300 volts and $V_1$ were 350 volts when equal charges were detected at the sensor, then $I_0 = 350/300 - 1 = 0.16667$ or 17%

Figure 2:
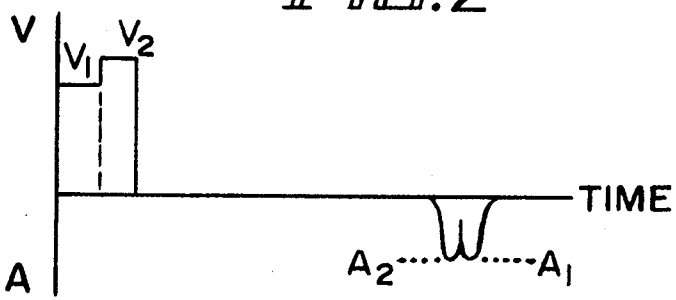
FIG. 2 is a waveform diagram useful in understanding the invention.

Once the first order inductive fraction is known the higher order fractions can be empirically determined. All orders beyond the second order are quite small and can be neglected (see FIG. 8A). Indeed, even the second order can often be neglected with good results. The compensation data in the PC memory can then be updated. This will optimize the compensation data which in turn will optimize the quality of printing. FIG. 2 illustrates this approach. When the detected charge signals $A_1$ and $A_2$ are equal the voltages used to charge them, $V_1$ and $V_2$, are the values used to determine the induction coefficients. All subsequent voltages can be adjusted via the processing scheme (FIG. 14) and stored in the PC memory.

Returning to the physics of the phenomena, and somewhat more rigorously, the charge on the break-off drop is reduced by a fraction of the charge on its immediate predecessor and by a smaller fraction of the charge on the drop preceding it by two drop times and so on. These induction fractions (sometimes referred to as inductive coefficients) are $I_1, I_2, \ldots I_n$ respectively. In a typical system, approximate values for $I_n$ and $I_2$ are 7% to 20% and 1% to 4% respectively. All other I's may be assumed to be negligible, as can be seen from FIG. 8A. This figure is a plot of induction fraction versus coefficient order for a typical ink jet printer. The upper curve represents center stream alignment. The lower curve is off center relative to the plates. In both cases the drop off in the fraction is such that higher orders may be safely ignored.

For illustrative purposes, it is sufficient to consider only the break-off drop (the drop being charged) and its immediate predecessor. The charge, $q_1$, on this drop can then be written as follows:

$$q_1 = -CV_1 - I_1 q_0 \quad (1)$$

where C is the capacitance of the charge tunnel to the stream, $V_1$ is the voltage applied to the charge tunnel, and $q_0$ is the charge of the preceding drop (negative). More generally:

$$q_n = -CV_n - I_1 q_{n-1} \quad (2)$$

Where $q_n$ is the charge on the nth drop in a string of drops, $q_{n-1}$ is the charge on the preceding drop, and $V_n$ is the voltage applied to the charge tunnel to charge the nth drop. If we express $q_2$ using equation 2, and insert equation 1 we have:

$$q_2 = -CV_2 - I_1(-CV_1 - I_1 q_0)$$

The $I_1^2$ term is very small and can be neglected leaving:

$$q_2 = -C(V_2 - I_1 V_1) \quad (3)$$

Hence, to charge a drop to the value—$CV_2$, the charging voltage must be raised to $V' = V_2 + I_1 V_1$. For each printer series drop position compensation data and induction coefficients are determined at the factory.

These data are the nominal or calibrated values when the printers are shipped.

In order to perceive the cause of the print quality problems shown in FIG. 4, it is necessary to determine what happens to the quantities in equation 3 when the stream is moved away from the charge tunnel axis. Since $V_0$ and $V_1$ are independent of stream position, we need only consider how C and $I_1$ are affected.

The capacitance between any two objects is determined by the geometry of the system (apart from a constant related to the materials in the system). In a jet printer, C has its minimum value when the stream is centered in the charge tunnel and increases as the stream is moved away from this position. By itself, a change in C is not troublesome (provided drop spacing is held constant), since all charges are increased (or decreased) by the same factor. This is equivalent to a change in the gain of the charge amplifier. In general, print quality is unaffected by minor gain changes as a result of proportional changes in capacitance.

Similarly, drop-to-drop spacing changes are effectively changes in the geometry so it follows that the inter-capacitance between all drops increases if the drop-to-drop spacing decreases and vice versa. This change causes I(1), I(2), . . . I(n) to change in a manner similar to the ink stream misalignment or charge tunnel mis-dimensioning effect. As an example, if the drop-to-drop spacing is out of specification by 5%, an approximate 5% change in I(1) will be observed. This change will not only be present in I(1) but will also be reflected in I(2) . . . I(n).

To summarize, stream misalignment within the charge tunnel, electrode spacing deviations or inter-drop spacing errors cause non-proportional effects on $I_1 \ldots I_n$. This can be seen by examining equation (1) and noting that $I_1$'s effect is additive.

It is possible to measure the induction fraction, $I_1$, as a function of stream position within the charge tunnel. For this purpose an experiment was performed using a 0.040" gap charge tunnel. Single drops charged to 287.5 volts were deflected into a Faraday cup (Monroe Electronics Model 253 Nanocoulomb Meter—a static charge measurement device). Approximately 1,000 charged drops, each separated by four grounded drops, were deflected into the cup producing a total charge accumulation of approximately 2 nanoCoulombs, an amount within the measurement capability of the device. By counting the number of deflected drops and noting the total charge measured, it was possible to calculate q, the charge on each drop.

Next, in a similar experiment, approximately 1,000 pairs of charged drops, each pair separated by 4 ground drops, were deflected into the cup, producing approximately 4 nanoCoulombs of charge. By counting the number of deflected pairs and noting the total charge measured, it was possible to calculate the sum of the charges on the first and second drops of the pair (adjacent drop and break-off drop), $Q=q_0+q_1$. Since the adjacent drop is preceded by an uncharged drop, its charge is identical to the charge observed when deflecting a single drop, $q0=q$. The difference in charge between $q_0$ and $q_1$ is the reduction in charge on the break-off drop due to the presence of the adjacent drop. Mathematically (from equation 1):

$$q_0-q_1=I_1q_0$$

Using the fact that $q_0=q$ and noting that $2q-Q=q_0-q_1$, $I_1$ can be determined in terms of the two measured quantities, q and Q:

$$I_1=2-Q/q$$

Figure 7:
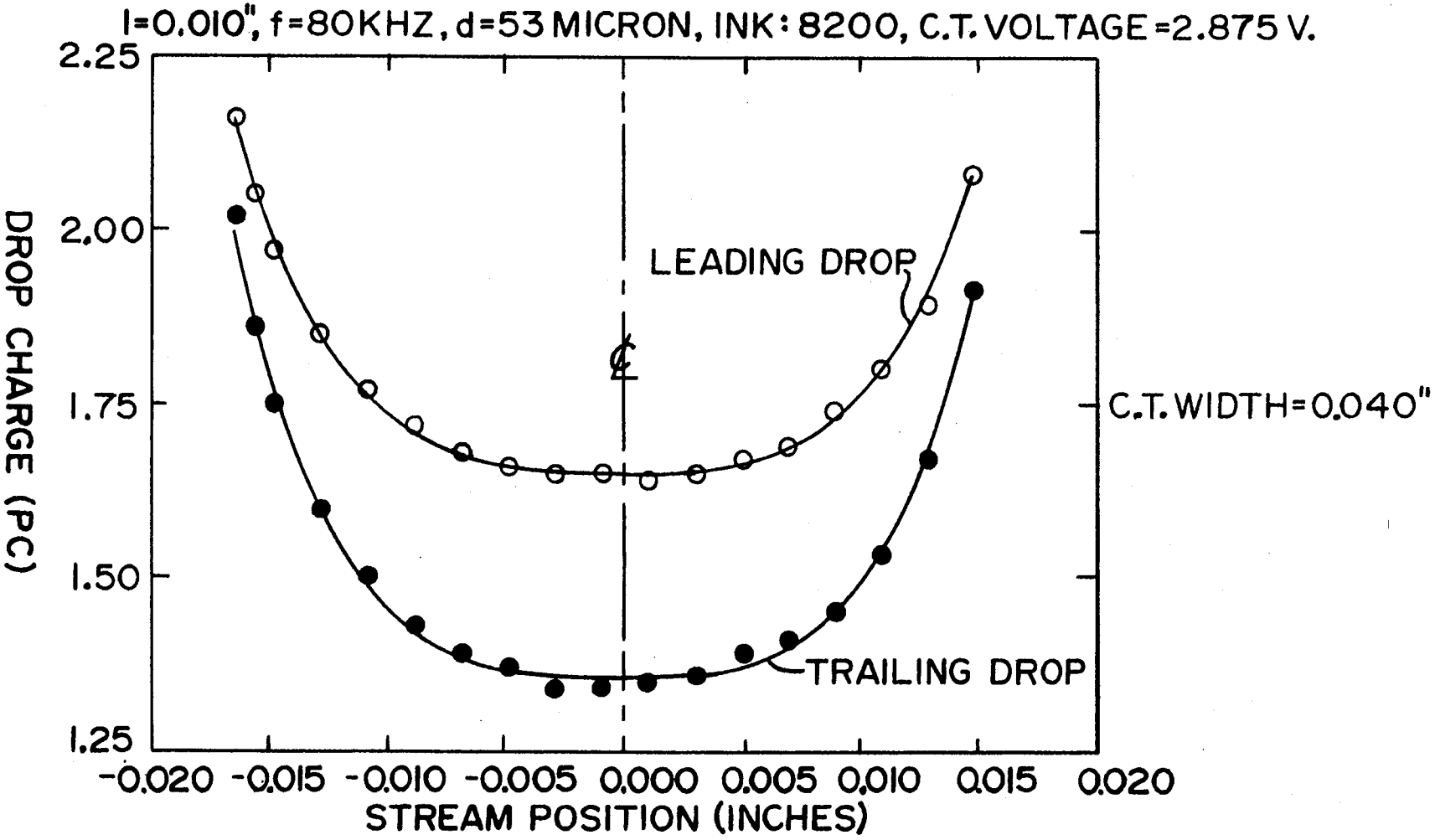
FIG. 7 is a plot of drop charge versus stream position.
Figure 8:
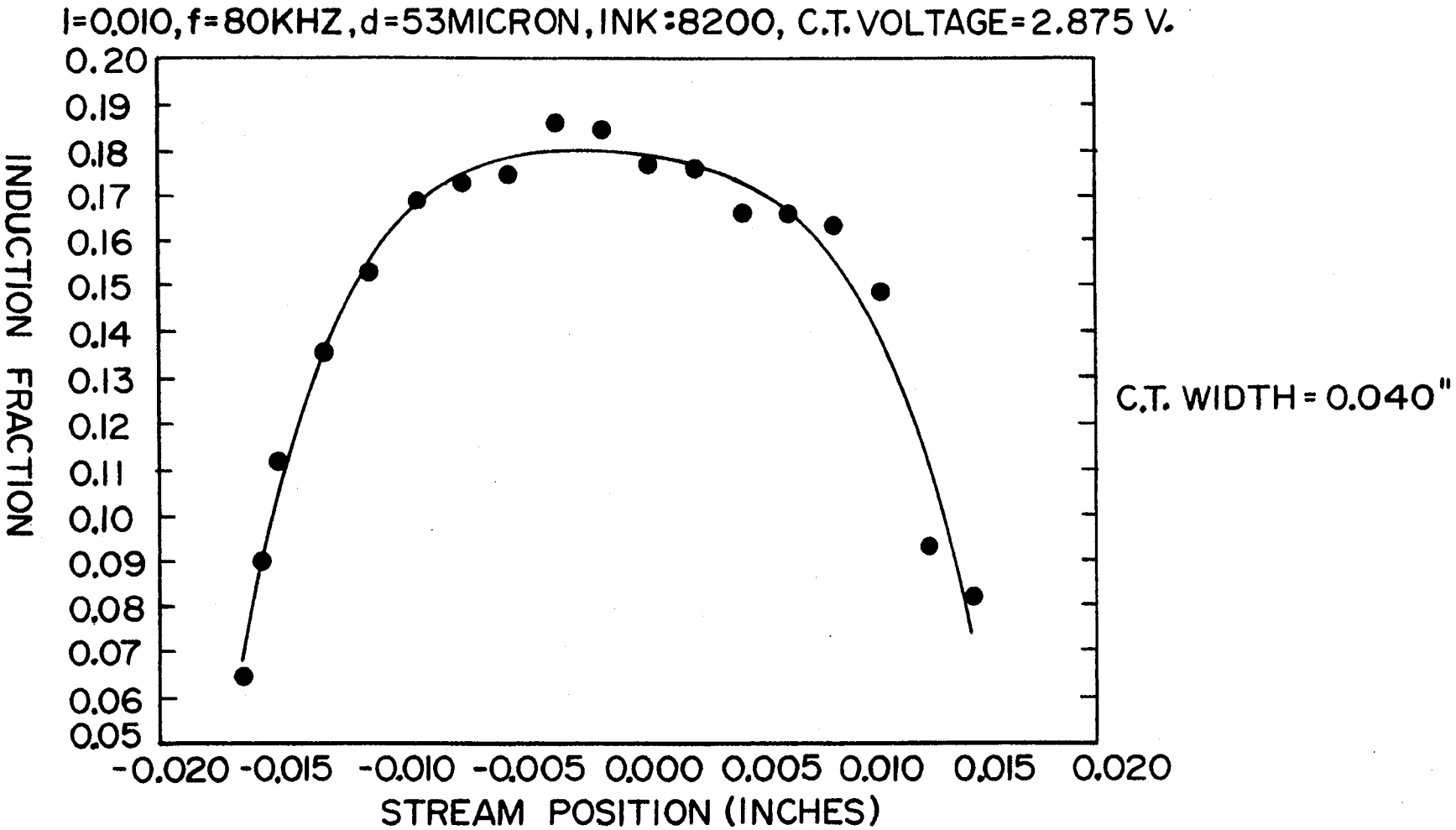
FIG. 8 is a plot of drop charge induction versus stream position.
Figure 8A:
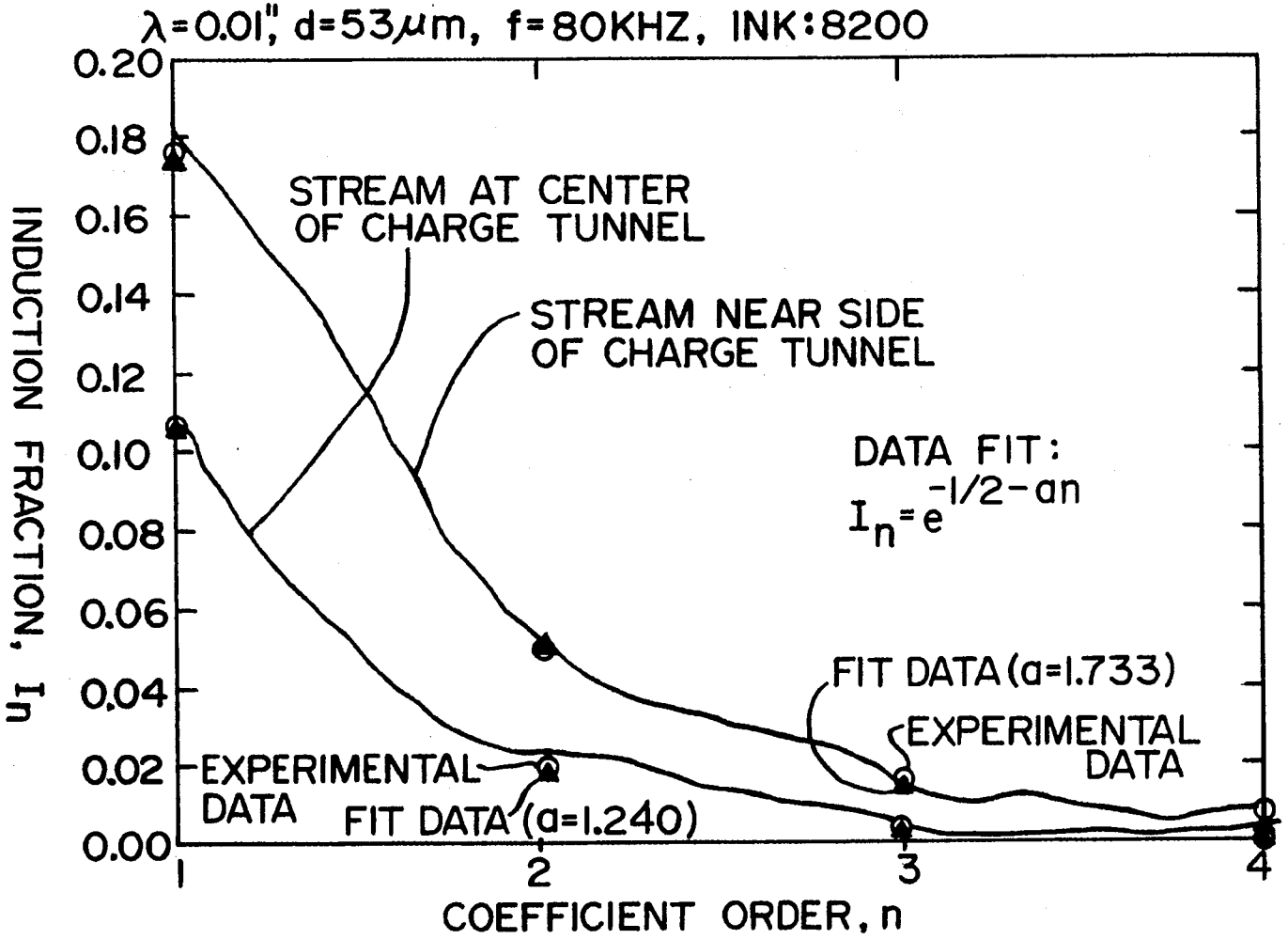
FIG. 8A is a curve fit plot of induction fraction, $I_n$ versus coefficient order, n.

FIG. 7 is a plot showing the difference in charge between $q_0$ (the adjacent or leading drop) and $q_1$ (the break-off or trailing drop) for various stream positions within the charge tunnel. FIG. 8 is a plot of $I_1$ versus stream position. As can be seen from the figures, the induction fraction, $I_1$ decreases rapidly as the stream approaches either plate of the tunnel. A similar experiment with a 0.030" tunnel yields the fact that the induction fraction for the 0.040" width tunnel is 3%–4% greater than that of the 0.030" width tunnel. This indicates that both stream position and charge tunnel width are determining factors in the quality of the print observed when printing with every drop. For example, it is evident that either an improperly aligned charge tunnel of the correct width or a properly aligned tunnel of an incorrect width can cause a several percent change in $I_1$ ("correct width" means the width of the charge tunnel used during factory calibration). Under either of these conditions, a drop following a charged drop will be incorrectly compensated by several percent. That is, a drop following a charged drop will receive an incorrect charge causing drop placement errors.

FIG. 3 is a print sample taken with a properly aligned charge tunnel of correct width. This sample exhibits correct drop placement. In comparison, FIG. 4 shows print samples exhibiting poor quality due to an improperly aligned charge tunnel. As detailed hereafter, according to the invention it is possible to mathematically adjust the charging voltages for a change in the drop induction fraction due to tunnel misalignment, out of specification tunnel width or drop spacing. The process adjusts the voltages by small amounts until the voltage data correctly compensates for the drop induction effect.

FIG. 5 is a print sample taken with the same tunnel misalignment as that in FIG. 4 but with mathematically adjusted voltage data. This sample indicates the feasibility of this type of calibration procedure.

Referring to FIGS. 9–14 there is disclosed the method for making the drop charge induction corrections. FIG. 9 shows the general procedure which is applicable to all of the specific procedures described in connection with FIGS. 10–13. At start-up, the printer is turned on, as is the ink supply. A measurement is then performed, step 100, to determine the correct induction factors. The test performed varies depending upon which of the procedures disclosed herein is utilized. After completing the test, the data obtained is processed to produce corrected induction factors, step 102 after which the ink jet printer is ready for use. The data processing step 102 is described in connection with FIG. 14 hereafter.

Figure 10:
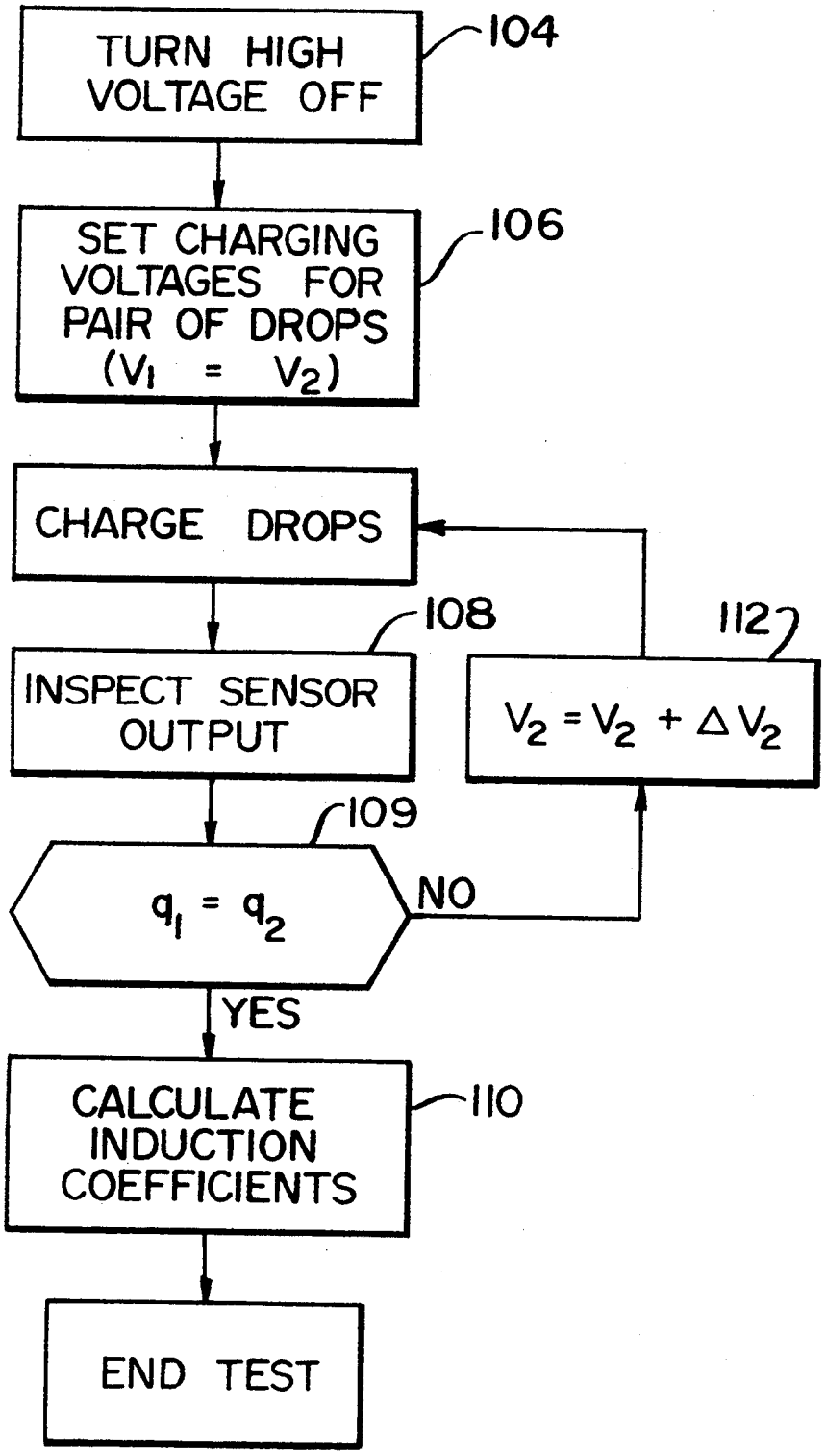

Referring to FIG. 10 a first and preferred measurement procedure is disclosed. According to this procedure, the high voltage to the deflection electrodes 22 and 24 is turned off, step 104. Equal charge voltages are applied to the tunnel electrodes 14 and 16 (step 106). The pair of drops are then charged and the drop charge detected by the detector 30 and its capacitive pickup, step 108. The charging voltage for the trailing drop, $V_2$ is incremented, step 112 and the process repeated until the condition $q_1=q_2$ is satisfied (step 109). The induction coefficients are calculated at step 110 from the equation:

$$I_n = \alpha^{1-n}\left(\frac{V_2}{V_1} - 1\right)^n, \alpha = e^{-\frac{1}{2}}$$

where n is the order of correction.

Figure 11:
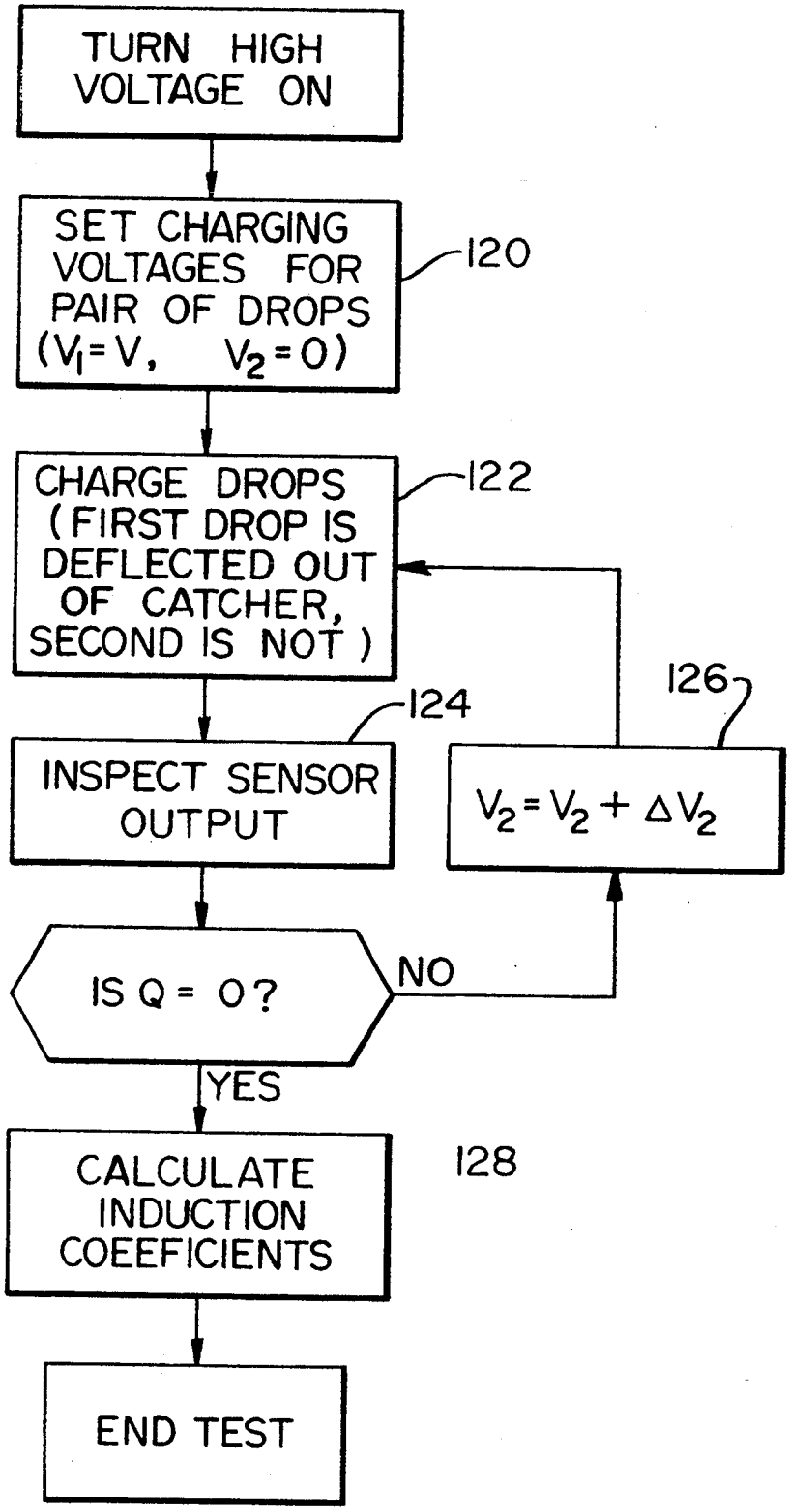

Referring to FIG. 11, a second test procedure according to the invention is disclosed. In this procedure, the deflection plates are turned on, rather than off. The charging voltages for a drop pair $d_1$ and $d_2$ are set at $V_1=V$ (such that the drop will be deflected out of the stream) and $V_2$ initially equal to zero (step 120). The first drop is then charged to $-CV$ and the following drops in a steam of drops are charged oppositely via induction from drop one ($q_2=I_1CV$; $q_3=CV$; $(I_2-I_1^2)$, step 122. The drop stream passes to the catcher. A sensor 31 located proximate to the ink catcher 28 is employed to detect the induced charge on the drop stream when it enters the catcher, step 124. The controller then determines the magnitude of the charge, Q ($Q=q_2+q_3$. . . ) on the stream. If Q does not equal zero, $V_2$ is incremented and the process is repeated, step 126. When $Q=0$ the induction coefficients are calculated, step 128 using the formula:

$$I_n = \alpha\left(1 + \frac{\alpha V_1}{V_2}\right)^{-n}, \alpha = e^{-\frac{1}{2}}$$

Figure 12:
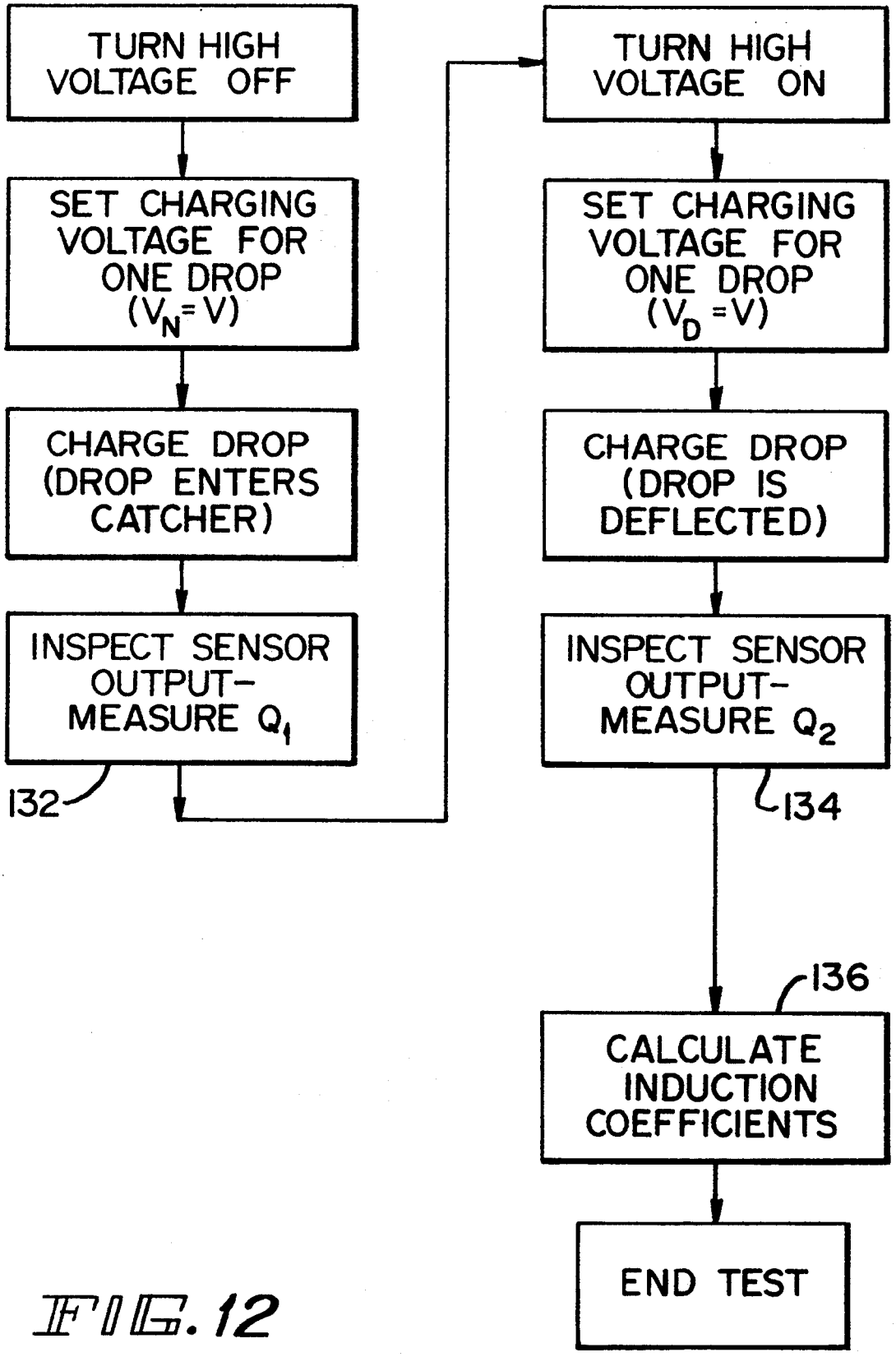

Referring to FIG. 12, a third test procedure is disclosed. In this procedure, the high voltage plates are turned off and only the first drop in a stream is charged with a voltage V, step 130. The charged drop and drops on which it induces charges enter the catcher 28 and the total charge $Q_1$ is sensed by a detector 31 located proximate thereto, step 132. The process is then repeated with the high voltage plates turned on (thus deflecting the first drop) and the total charge $Q_2$ detected by the sensor is again determined, step 134. From this information the induction coefficients can be calculated, step 136 using the formula:

$$I_n = \alpha\left(1 - \frac{\alpha Q_1}{Q_2}\right)^{-n}, \alpha = e^{-\frac{1}{2}}$$

Figure 13:
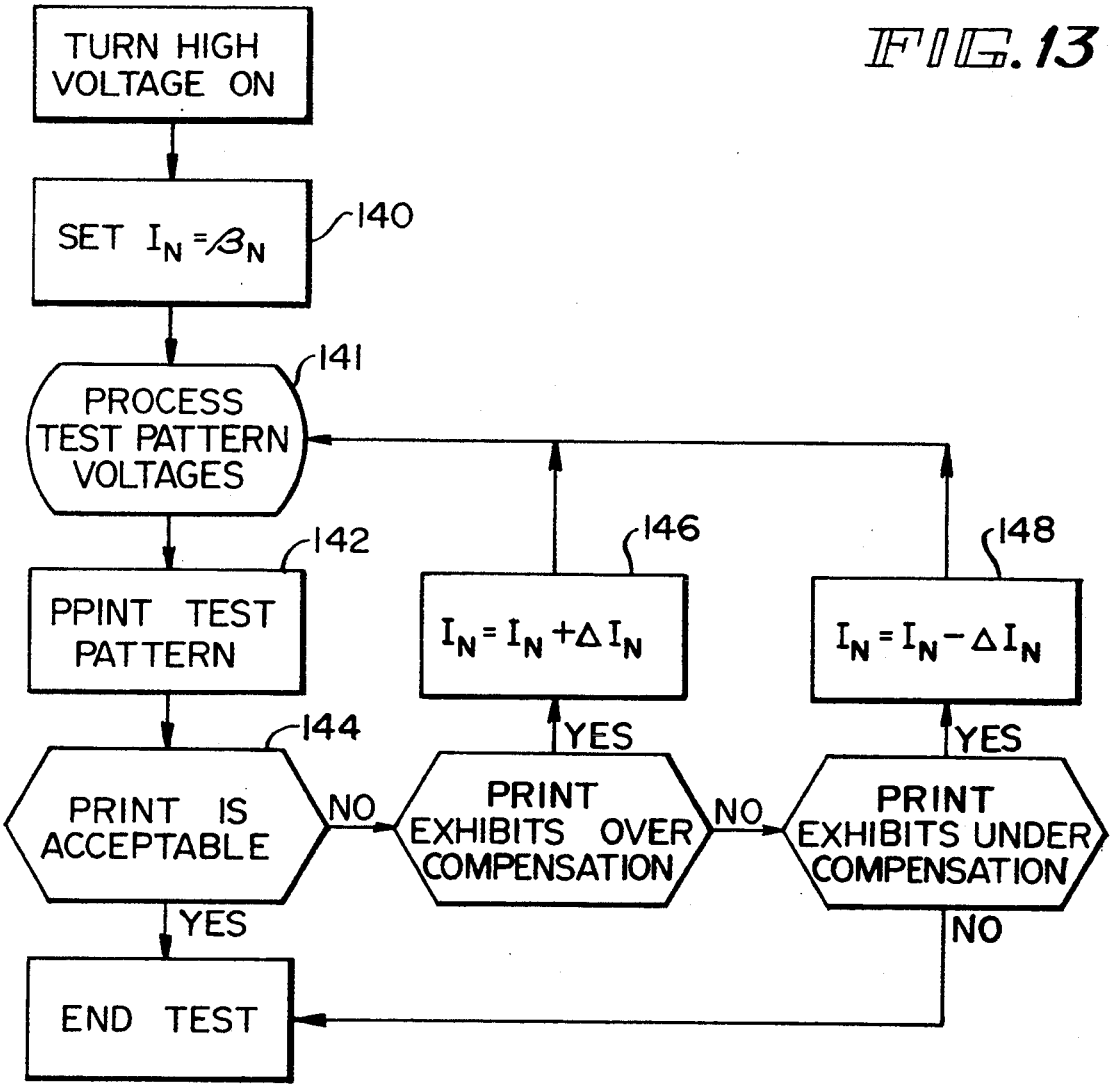

Referring to FIG. 13 a fourth test procedure is disclosed. In this procedure the high voltage is on and the induction coefficients $I_n$ ($n=1, 2, \ldots$) are set to a factory value $\beta_n$, step 140. Test pattern voltages are then printed, step 141 and a determination is made by the operator whether the print is acceptable, step 144. If the $\beta$ values result in overcompensation an adjustment is made, step 146. If under-compensation is detected an opposite adjustment is made, step 148. New test pattern voltages are then computed and a further pattern printed until acceptable print is obtained.

It will be recognized that step 140, the selection of an initial $I_n$ can be determined by any of the test procedures described in connection with FIGS. 10–12 (each of which generates a $I_n$) or using factory settings ($\beta_n$) as the seed and altering the values based on the results of the print test at step 142.

Figure 14:
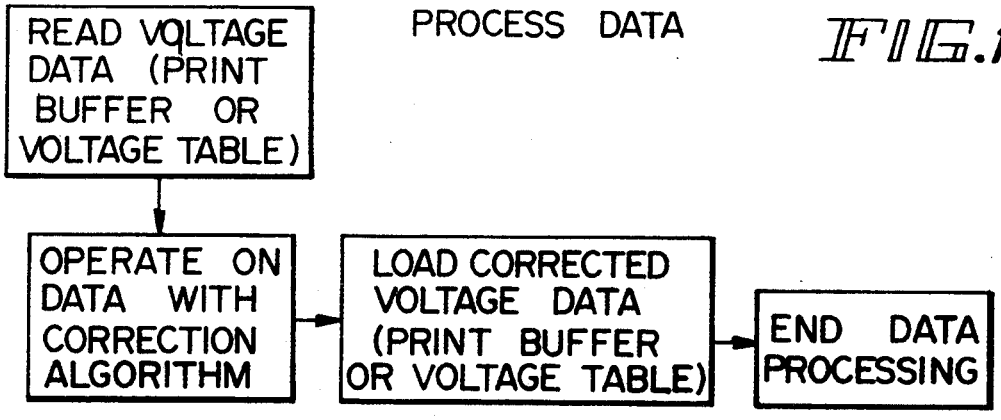

Referring to FIG. 14, the sequence for processing the test pattern voltages is illustrated. In the preferred embodiment the voltage data used to charge the plates 14 and 16 is stored in the memory of the programmable controller 18, usually in the form of a print buffer or voltage table. The data consist of a series of voltage values $V_1$ through $V_n$. The printer comes from the factory with a set of voltage data in the table as the default values. In order to alter the values in the table they are read in by the controller and a correction algorithm is employed. Alternatively, the values can be read into the controller on the fly and altered by the correction algorithm to produce corrected voltages for the charge tunnel. The preferred formula is:

$$\Phi_n = V_n + (I_1-\beta_1)V_{n-1} + \{(I_2-\beta_2)-\beta_1 \cdot (I_1-\beta_1)\}V_{n-2}$$

where $\Phi$ are corrected charging voltages; $\beta_n$ are nominal values of the induction coefficients and $I_n$ are actual values of induction coefficients as measured during the correction procedure.

It should be noted that this equation is a second order correction. It is unlikely that a higher order correction would be required, although it can be accomplished by simply extending the series. In practice, a first order correction will be satisfactory for many purposes. In that case, the bracketed term is set to zero. After the correction algorithm is used, the corrected voltage data $\Phi_1$ through $\Phi_n$ is stored in the voltage table and thereafter employed for printing. With these corrections, the improved printing illustrated in FIG. 5 is obtained, even with charge tunnel misalignment.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed is:

1. A method for field adjusting factory calibrated charge tunnel voltages, $V_n$ to reduce printing distortion comprising the steps of:

a) measuring actual values of induction coefficients, $I_m$ for said printer;

b) altering the voltages $V_n$ by a factor related to a difference between $\beta_m$, factory calibrated induction coefficients, and $I_m$ to obtain adjusted voltages $\Phi_n$;

c) employing the adjusted voltages $\Phi_n$ for printing.

2. The method according to claim 1 wherein the voltages $V_n$ are altered according to a formula:

$$\Phi_n = V_n + (I_1-\beta_1)\, V_{n-1}$$

for a first order correction.

3. The method according to claim 1 wherein the voltages $V_n$ are stored in a memory element associated with said printer in the form of a default voltage table and where the method further includes the steps of:

reading the voltages $V_n$ from said default voltage table to permit alteration;

storing the adjusted voltages $\Phi_n$ in said memory element in a corrected voltage table;

printing from the corrected voltage table rather than the default voltage table.

4. The method according to claim 1 wherein the voltages $V_n$ are altered according to a formula:

$$\Phi_n = V_n + (I_1 - \beta_1)V_{n-1} + [(I_2 - \beta_2) - \beta_1 \cdot (I_1 - \beta_1)]V_{n-2}$$

for a second order correction.

5. The method according to claim 1 wherein the step of measuring the induction coefficients $I_n$ includes the substeps of:

a) applying voltages $V_1$ and $V_2$, $V_2$ initially being equal to $V_1$, to a pair of test drops $d_1$ and $d_2$ respectively to induce charges $q_1$ and $q_2$ on said drops;

b) measuring induced charges $q_1$ and $q_2$;

c) incrementing $V_2$ and repeating steps a) and b) until $q_1 = q_2$;

d) calculating the actual induction coefficients, $I_m$, using the values of $V_1$ and $V_2$ when $q_1 = q_2$.

6. The method according to claim 5 wherein the step of calculating $I_n$ employs a formula:

$$I_n = \alpha^{1-n}\left(\frac{V_2}{V_1} - 1\right)^n, \alpha = e^{-\frac{1}{2}}$$

where n is the order of correction.

7. The method according to claim 1 wherein the step of measuring the induction coefficients $I_n$ includes the substeps of:

a) applying voltages $V_1$ and $V_2$, $V_2$ initially being zero, to a pair of test drops $d_1$ and $d_2$ in a drop stream to induce charges $q_1$ and $q_2$ on said drops;

b) electrostatically deflecting the drop $d_1$ out of a path of said drop stream, remaining drops in said drop stream, including $d_2$, being received in an ink catcher;

c) measuring the drop stream charge Q, where $Q = q_1 + q_2 + \ldots q_n$, as the stream enters the catcher;

d) incrementing $V_2$ and repeating steps a), b) and c) until $Q = 0$;

e) calculating the actual induction coefficients $I_n$ using the values $V_1$ and $V_2$ when $Q = 0$.

8. The method according to claim 7 when the step of calculating $I_n$ employs a formula:

$$I_n = \alpha\left(1 + \frac{\alpha V_1}{V_2}\right)^{-n}, \alpha = e^{-\frac{1}{2}}$$

9. The method according to claim 1 wherein the step of measuring the induction coefficients $I_n$ includes the substeps of:

a) applying a voltage V to a first drop in a drop stream directed at an ink catcher to apply a charge $q_1$ to said first drop and to induce charges $q_2, q_3 \ldots q_n$ on succeeding drops;

b) measuring a stream charge $Q_1$ where $Q_1 = q_1 + q_2 + \ldots q_n$ as the drop stream enters the catcher;

c) repeating step a);

d) electrostatically deflecting the first drop out of the drop stream path, the remaining drops in said stream passing to the catcher;

e) measuring the drop stream charge $Q_2$, where $Q_2 = q_2 + q_3 + \ldots q_n$, as the drop stream enters the catcher;

f) calculating the actual induction coefficients $I_n$ using a formula:

$$I_n = \alpha\left(1 - \frac{\alpha Q_1}{Q_2}\right)^{-n}, \alpha = e^{-\frac{1}{2}}$$

10. In an ink Jet printer including an ink supply, a nozzle and a stimulation means the nozzle to create a stream of ink drops, a charge tunnel to which voltages $V_n$ are applied by a programmable controller thereby to charge selected drops in said stream, deflection plates for deflecting charged drops and an ink catcher for receiving uncharged drops, the improvement comprising:

a system for field adjustment of factory calibrated charge tunnel voltages $V_n$ to reduce printing distortions of a printer including:

a) means for measuring an actual value of induction coefficients, $I_m$ for said printer;

b) means for altering the factory set voltages $V_n$ by a factor related to a difference between $\beta_m$, factory calibrated induction coefficients, and $I_m$ to obtain adjusted voltages $\Phi_n$;

c) said programmable controller employing the adjusted voltages $\Phi_n$ for printing.

11. The system according to claim 10 wherein the voltages $V_n$ are altered according to a formula:

$$\Phi_n = V_n + (I_1 - \beta_1)V_{n-1}$$

for a first order correction.

12. The system according to claim 10 wherein the voltages $V_n$ and $\Phi_n$ are stored in a memory element associated with said printer in the form of a default voltage table and a corrected voltage table;

said controller printing from the corrected voltage table rather than the default voltage table.

13. The system according to claim 10 wherein the voltages $V_n$ are altered according to a formula:

$$\Phi_n = V_n + (I_1 - \beta_1)V_{n-1} + [(I_2 - \beta_2) - \beta_1 \cdot (I_1 - \beta_1)]V_{n-2}$$

for a second order correction.

14. The system according to claim 10 wherein the means for measuring includes:

a) a drop charge sensor operatively positioned to detect charges on drops in said stream, an output of said sensor being provided to said means for altering.

15. The system according to claim 14 wherein said sensor is positioned between said charge tunnel and said deflection plates.

16. The system according to claim 14 wherein said sensor is positioned in proximity to the ink catcher.

17. The system according to claim 10 wherein the means for altering includes said programmable controller which receives $I_m$ and $\beta_m$ and calculates the adjusted voltages, $\Phi_n$ according to a formula:

$$\Phi_n = V_n + (I_{1-\beta 1})V_{n-1}$$

for a first order correction.

* * * * *